US009069269B2

(12) United States Patent
Tanaka et al.

(10) Patent No.: US 9,069,269 B2
(45) Date of Patent: Jun. 30, 2015

(54) TONER FOR ELECTROSTATIC LATENT IMAGE DEVELOPMENT AND METHOD OF PRODUCING TONER FOR ELECTROSTATIC LATENT IMAGE DEVELOPMENT

(71) Applicant: KYOCERA Document Solutions Inc., Osaka (JP)

(72) Inventors: Takanori Tanaka, Osaka (JP); Masashi Tamagaki, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 13/668,630

(22) Filed: Nov. 5, 2012

(65) Prior Publication Data

US 2013/0122415 A1 May 16, 2013

(30) Foreign Application Priority Data

Nov. 10, 2011 (JP) ..... 2011-246882

(51) Int. Cl.
*G03G 9/087* (2006.01)
*G03G 9/08* (2006.01)

(52) U.S. Cl.
CPC ..... *G03G 9/0808* (2013.01); *G03G 9/081* (2013.01); *G03G 9/0815* (2013.01); *G03G 9/0817* (2013.01); *G03G 9/0819* (2013.01); *G03G 9/0825* (2013.01); *G03G 9/0827* (2013.01); *G03G 9/08755* (2013.01)

(58) Field of Classification Search
CPC . G03G 9/0819; G03G 9/0825; G03G 9/0827; G03G 9/08755; G03G 9/081; G03G 9/0808; G03G 9/0817
USPC ..... 430/110.3, 110.1, 110.4, 109.4, 137.2
See application file for complete search history.

(56) References Cited

U.S. PATENT DOCUMENTS

| | | | | |
|---|---|---|---|---|
| 5,300,386 | A | 4/1994 | Kanbayashi et al. | |
| 7,459,255 | B2 * | 12/2008 | Tanaka et al. | 430/110.3 |
| 7,575,840 | B2 * | 8/2009 | Teramoto et al. | 430/106.1 |
| 2009/0233212 | A1 | 9/2009 | Fujikawa et al. | |
| 2011/0136060 | A1 | 6/2011 | Fujikawa et al. | |
| 2011/0143277 | A1 | 6/2011 | Shiotari et al. | |

FOREIGN PATENT DOCUMENTS

| | | | |
|---|---|---|---|
| JP | 5-88409 | A | 4/1993 |
| JP | 2003177571 | A | 6/2003 |
| JP | 2008-170901 | A | 7/2008 |
| WO | 2009084620 | A1 | 7/2009 |

OTHER PUBLICATIONS

Extended European Search Report issued to EP Application No. EP12190489.0, mailed Feb. 1, 2013.
Patent Abstracts of Japan JP 2003-177571, dated Jun. 27, 2003.
Notice of Reasons for Rejection issued to JP Application No. 2011-246882 mailed Sep. 24, 2013.
English Translation of WO2009/084620.

* cited by examiner

*Primary Examiner* — Janis L Dote
(74) *Attorney, Agent, or Firm* — Knobbe Martens Olson & Bear LLP

(57) ABSTRACT

There is disclosed a toner for electrostatic latent image development which includes at least a colorant, a charge control agent, and a release agent in a binder resin and is produced using a pulverizing process. An average circularity of the toner is 0.960 or more and 0.980 or less with respect to toner particles having a primary particle diameter of 3 μm or more and 10 μm or less. A numerical proportion of toner particles, having a concave portion of which outer diameter is 200 nm or more and being observed by a predetermined condition, is 10% by number or less.

5 Claims, 1 Drawing Sheet

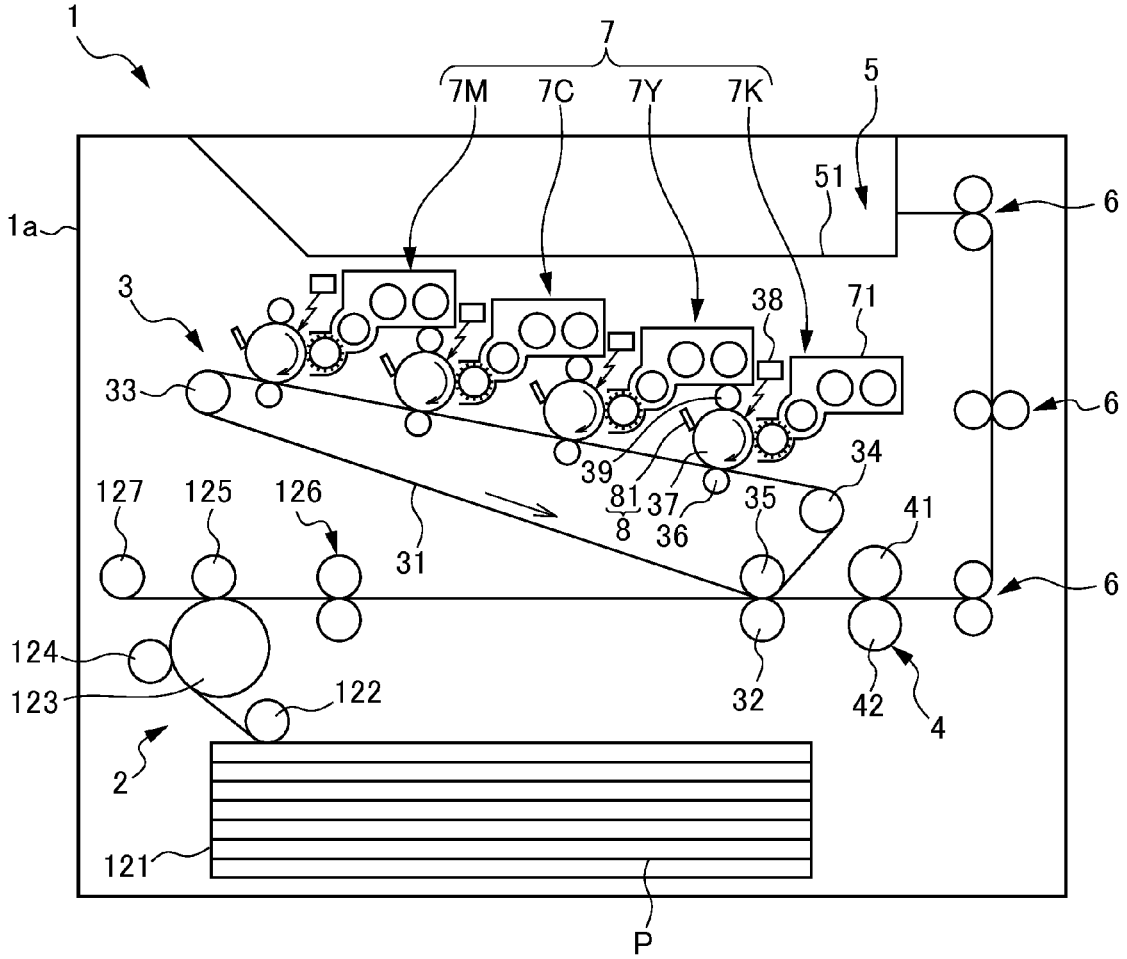
1
7
7M
7C
7Y
7K
5
51
1a
6
3
38
71
33
6
39
81
37
34
8
36
35
41
127
125
126
31
6
124
123
122
32
42
4
2
121
P

TONER FOR ELECTROSTATIC LATENT IMAGE DEVELOPMENT AND METHOD OF PRODUCING TONER FOR ELECTROSTATIC LATENT IMAGE DEVELOPMENT

REFERENCE TO RELATED APPLICATIONS

This application is based upon and claims the benefit of priority from the corresponding Japanese Patent Application No. 2011-246882, filed in the Japan Patent Office on Nov. 10, 2011, the entire contents of which are incorporated herein by reference.

FIELD

The present disclosure relates to a toner for electrostatic latent image development and a method of producing a toner for electrostatic latent image development.

BACKGROUND

In electrophotography, generally, a surface of a latent image carrier is charged using corona discharge etc. followed by exposure using laser etc. to form an electrostatic latent image, which is then developed and visualized using a developer such as a toner to obtain an image with high quality. The toner used for such a development method is typically one produced by mixing a binder resin with components such as a colorant, a charge control agent, and a release agent to obtain a mixture, then which is further melted and kneaded, followed by pulverizing and classifying the melt-kneaded material to form toner particles with an average particle diameter of 5 μm or more and 10 μm or less. Then, in order to provide flowability to the toner, to perform charge control of the toner, and to facilitate cleaning of the toner from the surface of the latent image bearing member, typically, an inorganic fine powder such as of silica and titanium oxide is added to a surface of the toner. In regards to such a toner, typically, a nearly spherical toner with a high circularity is often used in order to improve flowability thereof.

In the electrophotography, a transfer residual toner remains on the latent image bearing member after toner images are transferred from the latent image bearing member. Such a transfer residual toner is typically removed from the surface of the latent image bearing member by a cleaning unit having a mechanism such as an elastic blade. However, in a case in which the toner has a higher circularity, the transfer residual toner may pass through the cleaning unit and remain on the latent image bearing member. In such a case, image defects due to the transfer residual toner may occur in resulting images.

For the countermeasure, in order to prevent the transfer residual toner from passing through when cleaning the transfer residual toner, for example, there have been proposed a toner having a plurality of concave portions on a surface of toner particles and being produced by a suspension polymerization process and a toner in which concave and convex portions are formed on a surface of toner particles such that spans between tops of convex portions are within a certain range.

However, the two types of the toners described above, which have been proposed to prevent the transfer residual toner from passing through when cleaning the transfer residual toner, tend to adhere to the surface of the latent image bearing member; therefore, image defects called "void" may occur in resulting images since a portion of toner images is not transferred during the transfer. Furthermore, in the two types of the toners described above, the toners may become resistant to being charged to a desired potential and thus image density of resulting images may become lower than a desired value when printing at a lower coverage rate for a long period and thus the toners receive stress for a long period due to stirring within developing units.

The present disclosure has been made in view of the problems described above; and it is an object of the present disclosure to provide a toner for electrostatic latent image development in which occurrence of image defects in resulting images due to the toner passing-through cleaning units and image defects in resulting images such as void can be suppressed and image density of resulting images does not become lower than a desired value even when printing at a lower coverage rate for a long period. It is a further object of the present disclosure to provide a method of producing a toner for electrostatic latent image development which is adapted to the method of producing the toner for electrostatic latent image development described above.

The first aspect of the present disclosure is a toner for electrostatic latent image development. The toner includes at least a colorant, a charge control agent, and a release agent in a binder resin and is produced by a pulverizing process. An average circularity of the toner particles is 0.960 or more and 0.980 or less with respect to toner particles having a primary particle diameter of 3 μm or more and 10 μm or less. Furthermore, when 100 by number of the toner particles thereof are observed using a scanning electron microscope, a numerical proportion of toner particles having a concave portion of which outer diameter, measured using an image of the scanning electron microscope, is 200 nm or more is 10% by number or less.

Another aspect of the present disclosure is a method of producing the toner for electrostatic latent image development which includes the following steps (i) to (v):

(i) a step of mixing a binder resin, a colorant, a charge control agent, and a release agent, followed by melting and kneading them, (ii) a step of roughly pulverizing the melt-kneaded material resulting from the step (i) to obtain a coarsely pulverized material, (iii) a step of finely pulverizing the coarsely pulverized material by dividing a fine pulverization of the coarsely pulverized material into a plurality of times in series to obtain finely pulverized material, (iv) a step of classifying after the fine pulverization to obtain a classified material, and (v) a step of heat-treating the classified material to obtain a toner with a predetermined volume average particle diameter.

BRIEF DESCRIPTION OF THE DRAWINGS

FIG. 1 is a cross-section view which shows a configuration of an image forming apparatus.

DETAILED DESCRIPTION OF EMBODIMENTS

The present disclosure is explained in detail with respect to embodiments below; however, the present disclosure is not limited at all to the embodiments below and may be carried out with appropriately making a change within the purpose of the present disclosure. In addition, explanation may be occasionally omitted with respect to duplicated matters; this does not however limit the gist of the present disclosure. Hereinafter, the toner for electrostatic latent image development of the present disclosure and an image forming method using the toner for electrostatic latent image development of the present disclosure are explained.

Toner for Electrostatic Latent Image Development

The toner for electrostatic latent image development (hereinafter also referred to as merely "toner") is a pulverized toner and includes at least a colorant, a charge control agent, and a release agent in a binder resin. Furthermore, the toner for electrostatic latent image development of the present disclosure has an average circularity within a certain range and the content ratio of toner particles having a concave portion of which outer diameter, measured using a predetermined method, is 200 nm or more is no greater than a certain proportion.

In the toner for electrostatic latent image development of the present disclosure, the binder resin may be compounded with components such as a magnetic powder as required. Furthermore, in the toner for electrostatic latent image development of the present disclosure, optionally, an external additive may be attached to a surface of toner base particles. Still further, the toner for electrostatic latent image development of the present disclosure may be optionally mixed with a carrier and used as a two-component developer. Hereinafter, the binder resin, the colorant, the charge control agent, the release agent, the magnetic powder, and the external additive of essential or optional components of the toner for electrostatic latent image development of the present disclosure, the carrier used in a case of employing the toner as a two-component developer, and also a method of producing the toner for electrostatic latent image development are explained in order.

Binder Resin

The binder resin included in the toner particles of the present disclosure may be those used heretofore for binder resins of toner particles without particular limitation thereto. Specific examples of the binder resin include thermoplastic resins such as styrene resins, acrylic resins, styrene-acrylic resins, polyethylene resins, polypropylene resins, vinyl chloride resins, polyester resins, polyamide resins, polyurethane resins, polyvinyl alcohol resins, vinyl ether resins, N-vinyl resins, and styrene-butadiene resins. Among these resins, polyester resins are preferable in view of dispersibility of colorants in the toner, chargeability of the toner, and fixability to paper. Hereinafter, the polyester resin is explained.

Specific examples of the polyester resin are explained below. The polyester resin may be prepared by condensation polymerization or condensation copolymerization of an alcohol component and a carboxylic acid component. The components used for synthesizing the polyester resin are exemplified by bivalent, trivalent or higher-valent alcohol components and bivalent, trivalent or higher-valent carboxylic acid components below.

Specific examples of the bivalent, trivalent or higher-valent alcohols include diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, and polytetramethylene glycol; bisphenols such as bisphenol A, hydrogenated bisphenol A, polyoxyethylenated bisphenol A, and polyoxypropylenated bisphenol A; and trivalent or higher-valent alcohols such as sorbitol, 1,2,3,6-hexane tetrol, 1,4-sorbitane, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Specific examples of the bivalent, trivalent or higher-valent carboxylic acids include bivalent carboxylic acids such as maleic acid, fumaric acid, citraconic acid, itaconic acid, glutaconic acid, phthalic acid, isophthalic acid, terephthalic acid, cyclohexane dicarboxylic acid, succinic acid, adipic acid, sebacic acid, azealic acid, and malonic acid, or alkyl or alkenyl succinic acids including n-butyl succinic acid, n-butenyl succinic acid, isobutylsuccinic acid, isobutenylsuccinic acid, n-octylsuccinic acid, n-octenylsuccinic acid, n-dodecylsuccinic acid, n-dodecenylsuccinic acid, isododecylsuccinic acid, isododecenylsuccinic acid; and trivalent or higher-valent carboxylic acids such as 1,2,4-benzene tricarboxylic acid (trimellitic acid), 1,2,5-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxyl-2-methyl-2-methylene carboxypropane, 1,2,4-cyclohexane tricarboxylic acid, tetra (methylenecarboxyl)methane, 1,2,7,8-octanetetracarboxylic acid, pyromellitic acid, and Enpol trimer. These bivalent, trivalent or higher-valent carboxylic acids may be used as ester-forming derivatives such as an acid halide, an acid anhydride, and a lower alkyl ester. Here, the term "lower alkyl" means an alkyl group of 1 to 6 carbon atoms.

When the binder resin is a polyester resin, the softening point of the polyester resin is preferably 80° C. and higher and 150° C. or lower and more preferably 90° C. or higher and 140° C. or lower.

The polyester resin may be added with a cross-linking agent or a thermosetting resin within a range that does not inhibit the purpose of the present disclosure. By way of introducing a partial cross-linked structure into the polyester resin of the binder resin, properties of the toner such as storage stability, morphological retention, and durability may be improved without degrading fixability of the toner.

Preferable examples of the thermosetting resin usable in combination with the polyester resin are epoxy resins and cyanate resins. Specific examples of the preferred thermosetting resin include bisphenol-A type epoxy resins, hydrogenated bisphenol-A type epoxy resins, novolac-type epoxy resins, polyalkylene ether-type epoxy resins, cyclic aliphatic-type epoxy resins, and cyanate resins. These thermosetting resins may be used in a combination of two or more.

The glass transition point (Tg) of the binder resin (polyester resin) is preferably 50° C. or higher and 65° C. or lower and more preferably 50° C. or higher and 60° C. or lower. When the glass transition point is excessively low, the toner itself may agglomerate within developing units of image forming apparatuses, or the toner itself may partially agglomerate during shipping of toner containers or storage of toner container in warehouses etc. due to degradation of storage stability of the toner. Furthermore, when the glass transition point of the binder resin is excessively low, the toner tends to adhere to latent image bearing members due to lower strength of the binder resin. When the glass transition point of the binder resin is excessively high, fixability of the toner may degrade at lower temperatures.

Additionally, the glass transition point of the polyester resin can be determined from a changing point of specific heat of the polyester resin using a differential scanning calorimeter (DSC). More specifically, the glass transition point of the polyester resin can be determined by measuring an endothermic curve of the polyester resin using a differential scanning calorimeter (DSC-6200, by Seiko Instruments Inc.) as a measuring device. 10 mg of a sample to be measured is put into an aluminum pan and an empty aluminum pan is used as a reference, and an endothermic curve is measured under the conditions of a measuring temperature range of 25° C. or higher and 200° C. or lower, a temperature-increase rate of 10° C./min, and ambient environment of normal temperature and normal humidity, then the glass transition point can be determined from the resulting endothermic curve.

Colorant

The toner for electrostatic latent image development of the present disclosure includes a colorant in the binder resin. The colorant included in the toner for electrostatic latent image development may be used from conventional pigments and dyes depending on an intended color of the toner particles. Specific examples of the colorant adaptable to the toner may be exemplified by black pigments such as carbon black, acetylene black, lamp black, and aniline black; yellow pigments such as chrome yellow, zinc yellow, cadmium yellow, yellow iron oxide, mineral fast yellow, nickel titanium yellow, naples yellow, naphthol yellow S, hanza yellow G, hansa yellow 10G, benzidine yellow G, benzidine yellow GR, quinoline yellow lake, permanent yellow NCG, and tartrazine lake; orange pigments such as red chrome yellow, molybdenum orange, permanent orange GTR, pyrazolone orange, balkan orange, and indanthrene brilliant orange GK; red pigments such as iron oxide red, cadmium red, minium, cadmium mercury sulfate, permanent red 4R, lithol red, pyrazolone red, watching red calcium salt, lake red D, brilliant carmine 6B, eosine lake, rhodamine lake B, alizarin lake, and brilliant carmine 3B; violet pigments such as manganese violet, fast violet B, and methyl violet lake; blue pigments such as pigment blue 27, cobalt blue, alkali blue lake, Victoria blue partially chlorinated product, fast sky blue, and indanthrene blue BC; green pigments such as chrome green, chromium oxide, pigment green B, malachite green lake, and final yellow green G; white pigments such as zinc white, titanium dioxide, antimony white, and zinc sulfate; and extender pigments such as barite powder, barium carbonate, clay, silica, white carbon, talc, and alumina white. These colorants may be used in a combination of two or more for the purpose of tailoring the toner to a desired hue.

The amount of the colorant used is not particularly limited within a range that does not inhibit the purpose of the present disclosure. Specifically, it is preferably 1 part by mass or more and 10 parts by mass or less and more preferably 3 parts by mass or more and 7 parts by mass or less based on 100 parts by mass of the binder resin.

Charge Control Agent

The toner for electrostatic latent image development of the present disclosure contains a charge control agent in the binder resin. The charge control agent is used for the purpose of improving a charged level of the toner or a charge-increasing property which is an indicator of chargeability to a predetermined charged level within a short time, thereby obtaining a toner with excellent durability and stability. When the toner is positively charged to develop, a positively-chargeable charge control agent is used; and when the toner is negatively charged to develop, a negatively-chargeable charge control agent is used.

The charge control agent, usable for the toner for electrostatic latent image development of the present disclosure, is not particularly limited within a range that does not inhibit the purpose of the present disclosure and may be appropriately selected from conventional charge control agents used for toners heretofore. Specific examples of the positively-chargeable charge control agent are azine compounds such as pyridazine, pyrimidine, pyrazine, ortho-oxazine, meta-oxazine, para-oxazine, ortho-thiazine, meta-thiazine, para-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes consisting of azine compounds such as azine Fast Red FC, azine Fast Red 12BK, azine Violet BO, azine Brown 3G, azine Light Brown GR, azine Dark Green BH/C, azine Deep Black EW, and azine Deep Black 3RL; nigrosine compounds such as nigrosine, nigrosine salts, and nigrosine derivatives; acid dyes consisting of nigrosine compounds such as nigrosine BK, nigrosine NB, and nigrosine Z; metal salts of naphthenic acid or higher fatty acid; alkoxylated amines; alkylamides; quaternary ammonium salts such as benzylmethylhexyldecyl ammonium, and decyltrimethylammonium chloride. Among these positively-chargeable charge control agents, nigrosine compounds are particularly preferable from the viewpoint that a rapid charge rising property can be obtained. These positively-chargeable charge control agents may be used in a combination of two or more.

In addition, resins having a quaternary ammonium salt, a carboxylic acid salt, or a carboxyl group as a functional group may be used for the positively-chargeable charge control agent. More specifically, styrene resins having a quaternary ammonium salt, acrylic resins having a quaternary ammonium salt, styrene-acrylic resins having a quaternary ammonium salt, polyester resins having a quaternary ammonium salt, styrene resins having a carboxylic acid salt, acrylic resins having a carboxylic acid salt, styrene-acrylic resins having a carboxylic acid salt, polyester resins having a carboxylic acid salt, styrene resins having a carboxyl group, acrylic resins having a carboxyl group, styrene-acrylic resins having a carboxyl group, and polyester resins having a carboxyl group may be exemplified. Molecular weight of these resins is not particularly limited within a range that does not inhibit the purpose of the present disclosure; and oligomers or polymers may also be allowable.

Among the resins usable as the positively-chargeable charge control agent, styrene-acrylic resins having a quaternary ammonium salt as the functional group are more preferable since the charged amount may be easily controlled within a desired range. In regards to the styrene-acrylic resins having a quaternary ammonium salt as the functional group, specific examples of acrylic co-monomers preferably copolymerized with a styrene unit may be exemplified by (meth) acrylic acid alkyl esters such as methyl acrylate, ethyl acrylate, n-propyl acrylate, iso-propyl acrylate, n-butyl acrylate, iso-butyl acrylate, 2-ethylhexyl acrylate, methyl methacrylate, ethyl methacrylate, n-butyl methacrylate, and iso-butyl methacrylate.

Additionally, the units derived from dialkylamino alkyl (meth)acrylates, dialkyl(meth)acrylamides, or dialkylamino alkyl(meth)acrylamides through a quaternizing step may be used as the quaternary ammonium salt. Specific examples of the dialkylamino alkyl(meth)acrylate include dimethylamino ethyl(meth)acrylate, diethylamino ethyl(meth)acrylate, dipropylamino ethyl(meth)acrylate, and dibutylamino ethyl (meth)acrylate. A specific example of the dialkyl(meth)acrylamide is dimethyl methacrylamide. A specific example of the dialkylamino alkyl(meth)acrylamide is dimethylamino propylmethacrylamide. Additionally, hydroxyl group-containing polymerizable monomers such as hydroxy ethyl(meth) acrylate, hydroxy propyl(meth)acrylate, 2-hydroxy butyl (meth)acrylate, and N-methylol (meth)acrylamide may be used in combination at the time of polymerization.

Specific examples of the negatively-chargeable charge control agent include organic metal complexes and chelate compounds. Preferably, the organic metal complex or the chelate compound is acetylacetone metal complexes such as aluminum acetylacetonate and iron (II) acetylacetonate, or salicylic acid metal complexes or salicylic acid metal salts such as 3,5-di-tert-butylsalicylic acid chromium; and salicylic acid metal complexes or salicylic acid metal salts are more preferable. These negatively-chargeable charge control agents may be used in a combination of two or more.

The amount of the positively- or negatively-chargeable charge control agent used is not particularly limited within a range that does not inhibit the purpose of the present disclosure. The amount of the positively- or negatively-chargeable charge control agent used is typically 0.5 part by mass or more and 15 parts by mass or less based on 100 parts by mass of the total amount of the toner, more preferably 0.5 part by mass or more and 8.0 parts by mass or less, and particularly preferably 0.5 part by mass or more and 7.0 parts by mass or less. When the amount of the charge control agent used is excessively small, image density of the resulting images may be lower or it may become difficult to maintain image density of the resulting images for a long period since it is difficult to stably charge the toner in a predetermined polarity. Furthermore, in such a case, the charge control agent becomes resistant to being uniformly dispersed in the binder resin, thus fog tends to occur in the resulting images or smear with the toner tends to occur in latent image bearing members. When the amount of the charge control agent used is excessively large, image defects caused by an inferior charge under high temperature and high humidity due to degradation of environmental resistance tend to occur in the resulting images or smear with the toner tends to occur in latent image bearing members.

Release Agent

The toner for electrostatic latent image development of the present disclosure contains a release agent. The release agent is used in order to improve fixability and offset resistance of the toner. The type of the release agent added to the toner is not particularly limited within a range that does not inhibit the purpose of the present disclosure. The release agent is preferably a wax; and examples of the wax include polyethylene wax, polypropylene wax, fluorine resin wax, Fischer-Tropsch wax, paraffin wax, ester wax, Montan wax, and rice wax. These waxes may be used in a combination of two or more. By adding the release agent to the toner, occurrence of offset or image smearing (smear around images occurring upon rubbing the images) may be effectively inhibited in the resulting images.

The amount of the release agent used is not particularly limited within a range that does not inhibit the purpose of the present disclosure. The specific amount of the release agent used is preferably 1 part by mass or more and 5 parts by mass or less based on 100 parts by mass of the binder resin. When the amount of the release agent used is excessively small, the desired effect may not be obtained for inhibiting the occurrence of offset or image smearing in the resulting images, and when the amount of the release agent used is excessive large, the storage stability of the toner may be degraded due to the fusion of the toner itself.

Magnetic Powder

The toner of the present disclosure may be compounded with a magnetic powder in the binder resin. The type of the magnetic powder compounded in the toner is not particularly limited within a range that does not inhibit the purpose of the present disclosure. Specific examples of the preferable magnetic powder include iron oxides such as ferrite and magnetite, ferromagnetic metals such as cobalt and nickel, alloys of iron and/or ferromagnetic metals, compounds of iron and/or ferromagnetic metals, ferromagnetic alloys via ferromagnetizing treatment like heat-treatment, and chromium dioxide.

Particle diameter of the magnetic powder is not particularly limited within a range that does not inhibit the purpose of the present disclosure. Specifically, the particle diameter of the magnetic powder is preferably 0.1 μm or more and 1.0 μm or less and more preferably 0.1 μm or more and 0.5 μm or less. The magnetic powder with this range of particle diameter may be easily dispersed into the binder resin.

In order to improve dispersibility of the magnetic powder into the binder resin, for example, those surface-treated by a surface treatment agent such as a titanium coupling agent and a silane coupling agent may be used.

The amount of the magnetic powder used is not particularly limited within a range that does not inhibit the purpose of the present disclosure. In a case in which the toner is used as a one-component developer, the specific amount of the magnetic powder used is preferably 35 parts by mass or more and 60 parts by mass or less and more preferably 40 parts by mass or more and 60 parts by mass or less based on 100 parts by mass of the total amount of the toner. When the amount of the magnetic powder used is excessively large, image density is likely to be lower or fixability may be extremely deteriorated in a case of printing for a long period. When the amount of the magnetic powder used is excessively small, fog tends to occur in the resulting images or image density is likely to be lower in a case of printing for a long period. Additionally, in a case in which the toner is used as a two-component developer, the amount of the magnetic powder used is preferably 20 parts by mass or less and more preferably 15 parts by mass or less based on 100 parts by mass of the total amount of the toner.

External Additive

In the toner for electrostatic latent image development of the present disclosure, an external additive may be attached to a surface of toner particles (toner particles prior to being added with the external additive are sometimes referred to as "toner base particles") in order to improve properties of the toner such as flowability, storage stability, and cleaning ability.

The type of the external additive is not particularly limited within a range that does not inhibit the purpose of the present disclosure and may be appropriately selected from conventional external additives used for toners heretofore. Specific examples of the preferable external additive may be exemplified by metal oxides such as alumina, titanium oxide, magnesium oxide, zinc oxide, strontium titanate, barium titanate, and silica. These external additives may be used in a combination of two or more.

The particle diameter of the external additive is not particularly limited within a range that does not inhibit the purpose of the present disclosure; typically, the range of 0.01 μm or more and 1.0 μm or less is preferable.

The value of volume specific resistance of the external additive may be adjusted by forming a coating layer consisting of tin oxide and antimony oxide on the surface of the external additive and changing a thickness of the coating layer or a ratio of tin oxide to antimony oxide.

The amount of the external additive used based on the toner particles is not particularly limited provided that it is within a range that does not inhibit the purpose of the present disclosure. Typically, the amount of the external additive used is preferably 0.1 part by mass or more and 10 parts by mass or less and more preferably 0.2 part by mass or more and 5 parts by mass or less based on 100 parts by mass of the toner base particles prior to being treated using the external additive. When the external additive is used within this range, the toner excellent in flowability, storage stability, and cleaning ability may be easily obtained.

The process for attaching the external additive to the surface of toner base particles is not particularly limited thereto and may be appropriately selected from conventional processes. Specifically, treatment conditions are controlled such that particles of the external additive are not embedded into toner base particles, then the treatment of the external additive is performed using a mixer such as HENSCHEL MIXER or NAUTER MIXER.

Carrier

The toner for electrostatic latent image development of the present disclosure may be mixed with a desired carrier and used as a two-component developer. In a case of preparing the two-component developer, a magnetic carrier is preferably used.

A carrier, of which core material is coated with a resin, is exemplified as a usable carrier in the case of using the toner for electrostatic latent image development of the present disclosure for the two-component developer. Specific examples of the material of carrier core are particles of iron, oxidized iron, reduced iron, magnetite, copper, silicon steel, ferrite, nickel, and cobalt; alloy particles of these materials and manganese, zinc, aluminum, etc.; alloy particles of iron-nickel alloy, iron-cobalt alloy, etc.; ceramic particles of titanium oxide, aluminum oxide, copper oxide, magnesium oxide, lead oxide, zirconium oxide, silicon carbide, magnesium titanate, barium titanate, lithium titanate, lead titanate, lead zirconate, lithium niobate, etc.; particles of higher permittivity materials such as ammonium dihydrogen phosphate, potassium dihydrogen phosphate, and Rochelle salts; resin carriers dispersing these magnetic particles into resins; and the like.

Specific examples of the resin, for coating the core material of carrier, include (meth)acrylic polymers, styrene polymers, styrene-(meth)acrylic polymers, olefin polymers (polyethylene, chlorinated polyethylene, polypropylene), polyvinyl chloride, polyvinyl acetate, polycarbonate, cellulose resins, polyester resins, unsaturated polyester resins, polyamide resins, polyurethane resins, epoxy resins, silicone resins, fluorocarbon resins (polytetrafluoroethylene, polychlorotrifluoroethylene, polyvinylidene fluoride), phenol resins, xylene resins, diallyl phthalate resins, polyacetal resins, amino resins. These resins may be used in a combination of two or more.

Particle diameter of the carrier, which is not particularly limited within a range that does not inhibit the purpose of the present disclosure, is preferably 20 μm or more and 200 μm or less and more preferably 30 μm or more and 150 μm or less as a particle diameter measured by an electron microscope.

Apparent density of the carrier is not particularly limited within a range that does not inhibit the purpose of the present disclosure. Typically, the apparent density of the carrier, which depends on a carrier composition and surface structure, is preferably $2.4\times10^3$ kg/m$^3$ or more and $3.0\times10^3$ kg/m$^3$ or less.

When the toner for electrostatic latent image development of the present disclosure is used as the two-component developer, the content of the toner is preferably 1% by mass or more and 20% by mass or less and more preferably 3% by mass or more and 15% by mass or less based on the mass of the two-component developer. By adjusting the content of the toner in the two-component developer within these range, an appropriate image density may be maintained in the resulting images, and pollution with toner inside image forming apparatuses and adhesion of the toner to recorded media such as transfer paper may be suppressed because of inhibiting scattering of the toner.

Method of Producing Toner for Electrostatic Latent Image Development

The toner for electrostatic latent image development of the present disclosure is a pulverized toner and may be prepared by compounding the colorant, the charge control agent, the release agent, and optional components such as a magnetic powder into the binder resin, then the compounded mixture is melted and kneaded, followed by pulverizing and classifying the melt-kneaded material into a desired particle diameter. Typically, average particle diameter of the pulverized-classified toner, which is not particularly limited within a range that does not inhibit the purpose of the present disclosure, is preferably 5 μm or more and 10 μm or less.

Preferably, the production method of the toner particles is such that the binder resin, the colorant, the charge control agent, the release agent, and optional components such as a magnetic powder are mixed using a mixer, then the resulting mixture is melted and kneaded by a kneading machine such as a single or twin screw extruder to obtain a kneaded material. Then, the kneaded material after cooling is pulverized to obtain a pulverized material, followed by classifying the pulverized material. More preferably, in the pulverizing step, the kneaded material is coarsely pulverized to obtain a coarsely pulverized material, then the resulting coarsely pulverized material is further finely pulverized to obtain a finely pulverized material.

Furthermore, it is preferred in the production method that the finely pulverizing step is performed using a mechanical pulverizing device by dividing it into a plurality of times, preferably 3 times or more, in series such that the volume average particle diameter (D50) of the toner particles gradually decreases after each pulverizing step. In the toner of the present disclosure, the average circularity of toner particles having a primary particle diameter of 3 μm or more and 10 μm or less is 0.960 or more and 0.980 or less and more preferably 0.965 or more and 0.975 or less. By finely pulverizing in such a way, preparation of the toner having a predetermined average circularity may be facilitated.

In a case in which the average circularity of the toner of the present disclosure is excessively low, roundness of the toner diminishes, thus a contact friction coefficient between the toner and the latent image bearing member (photoconductor drum) increases and the toner becomes resistant to being peeled from surface of latent image bearing member when toner images are transferred from the latent image bearing member to recording media. In such a case, image defects referred to as voids may occur in the resulting images when transferred. On the other hand, in a case in which the average circularity is excessively high, the toner tends to pass through devices for removing transfer residual toner when cleaning the transfer residual toner attaching to latent image bearing member.

The average circularity of toner particles having a primary particle diameter of 3 μm or more and 10 μm or less can be measured in accordance with the method below. Here, the particles measured as particles having a primary particle diameter of smaller than 3 μm contain almost no toner particles, and the particles measured as particles having a primary particle diameter of greater than 10 μm contain a large amount of agglomerates composed of toner particles, therefore, the range of particle diameter of toner particles to determine the average circularity is limited to 3 μm or more and 10 μm or less.

Method of Measuring Average Circularity

An average circularity of the toner is measured using a Flow Particle Image Analyzer (FPIA-3000, by Sysmex Co.). Under an environment of 23° C. and 60% RH, toner particles having an equivalent circle diameter of 0.60 μm or more and 400 μm or less are measured for a circumferential length ($L_0$) of a circle having a projected area the same as that of the particle image and a peripheral length (L) of a particle-projected image, and the circularity is determined using the formula below. The sum of circularities of toner particles having an equivalent circle diameter of 3 μm or more and 10 μm or less is divided by a total particle number of toner particles used to measure having an equivalent circle diameter of 3 μm or more and 10 μm less, and the resulting value is defined as the average circularity.

(Equation to Calculate Circularity)

$$\text{Circularity}=L_0/L$$

Furthermore, it is preferred in the method of producing the toner that the toner after the classification is subjected to heat treatment. As described later, in the toner for electrostatic latent image development of the present disclosure, a content ratio of toner particles, having a concave portion of which outer diameter is 200 nm or more, is no greater than a certain proportion; here, the content ratio of toner particles, having a concave portion of which outer diameter is 200 nm or more, can be decreased by heat-treating the toner. The average circularity of the toner can also be increased by heat-treating the toner.

The heat-treatment condition is not particularly limited within a range that does not inhibit the purpose of the present disclosure. Typically, the heat-treatment condition is preferably 180° C. or higher and 220° C. or lower in terms of temperature. The heat-treatment is typically performed in a moment in order to avoid melting of the toner or fusion of the toner itself. A preferable heat-treatment process may be exemplified by a process using a heat-treatment device such as SUFFUSION (by Nippon Pneumatic Mfg. Co.).

In the toner of the present disclosure, a numerical proportion of toner particles, having a concave portion of which outer diameter is 200 nm or more, is 10% by number or less, more preferably 7% by number or less, and particularly preferably 5% by number or less based on toner particles observed, in which 100 by number of the toner particles are observed using a scanning electron microscope.

When the toner has an excessively high numerical proportion of toner particles having a concave portion of which outer diameter is 200 nm or more, the external additive tends to be embedded in concave portions of the toner due to impact shock from stirring/mixing screws within development devices when printing at a lower coverage rate for a long period. For this reason, when such a toner is used, it becomes difficult to uniformly charge the toner particles. Therefore, image density of the resulting images is likely to be lower than a desired value.

Here, the external additive typically exists in the toner as agglomerates (secondary particles) where primary particles thereof have agglomerated. In addition, the particle diameter of agglomerates of the external additive is often 7 times or more and 10 times or less of the particle diameter of primary particles in general. For this reason, in a case in which the outer diameter of a concave portion on toner surface is smaller than 200 nm, only a few agglomerate particles at most of the external additive can enter into the concave portion and thus embedment of the external additive is unlikely to occur.

Furthermore, even when the toner has a concave portion of which outer diameter is 200 nm or more, if the numerical proportion is lower, the effect thereof on chargeability of the toner can be very small on the basis of entire toner particles provided that the external additive is embedded in the concave portion.

The diameter of a concave portion of toner particles can be measured using a scanning electron microscope (SEM) in accordance with the process below.

Method of Measuring Numerical Proportion of Toner Particles Having Concave Portion with Outer Diameter of 200 nm or More 100 toner particles contained in an image taken at a magnification of 3000 using a scanning electron microscope are checked for existence or nonexistence of a concave portion with an outer diameter of 200 nm or more, and the number of toner particles having one or more concave portions with an outer diameter of 200 nm or more is counted. Base on the counted number of toner particles having a concave portion with an outer diameter of 200 nm or more, a numerical proportion of toner particles having a concave portion with an outer diameter of 200 nm or more versus 100 toner particles is calculated.

In addition, toner particles having a concave portion are measured for an outer diameter of the concave portion. The outer diameter of the concave portion is measured after the resulting image is image-treated and binarized by an automatic binarizing treatment (mode: P-tile) using an image analysis software (WINROOF, ver.5.5.0, by Mitani Co.). By way of the binarizing treatment, the toner in the image is distinguished between concave portions and other portions. With respect to the concave portions of the image after the binarizing treatment, a longest distance between two points selected arbitrarily on a circumference of a concave portion is determined as an outer diameter of the concave portion.

In addition, a volume average particle diameter of the toner may be measured by the method below.

Method of Measuring Volume Average Particle Diameter

A volume average particle diameter is measured using a Coulter Counter Multisizer 3 (by Beckman Coulter Inc.). Isoton II (by Beckman Coulter Inc.) is used as an electrolyte and an aperture of 100 μm is used as the aperture thereof. 10 mg of the toner is added to a solution of the electrolyte (Isoton II) to which a small amount of a surfactant have been added, and the toner is dispersed into the electrolyte using an ultrasonic dispersing device. An electrolyte where the toner has been dispersed is used as a measurement sample, and a particle size distribution of the toner is measured using the Coulter Counter Multisizer 3 to determine a volume average particle diameter of the toner.

In the toner for electrostatic latent image development of the present disclosure explained above, occurrence of image defects in resulting images due to the toner passing-through cleaning units and image defects in resulting images such as void can be suppressed and image density of resulting images does not become lower than a desired value even when printing at a lower coverage rate for a long period. For this reason, the toner for electrostatic latent image development of the present disclosure can be favorably used in various image forming apparatuses.

Image Forming Method

The image forming apparatus, employed for forming images using the toner for electrostatic latent image development of the present disclosure, may be appropriately selected from conventional image forming apparatuses without particular limitation as long as proper images can be formed. The image forming apparatus, which is employed for forming images using the toner for electrostatic latent image development of the present disclosure, is preferably a tandem-type color image forming apparatus which uses toners of two or more colors as described later. Hereinafter, the image forming method using the tandem-type color image forming apparatus is explained.

In this connection, the tandem-type color image forming apparatus explained below is equipped with two or more latent image bearing members which are arranged in parallel in order to form a toner image using toners with different colors on the surfaces of the two or more latent image bearing members and two or more developing units with rollers (development sleeves) which are disposed oppositely to the respective latent image bearing members, carry the toner on the surface and convey it, and supply the conveyed toner respectively to the surfaces of the latent image bearing members; in which the developing units supply the toners for electrostatic latent image development of the present disclosure to the latent image bearing members.

FIG. 1 is a schematic view that shows a configuration of an appropriate image forming apparatus. Here, the image forming apparatus is explained with reference to a color printer 1 as an example.

The color printer 1 has a box-type device body 1*a* as shown in FIG. 1. A paper feed unit 2 that feeds a paper P, an image forming unit 3 that transfers a toner image based on image data on the paper P as a recoding medium while conveying the paper P fed from the paper feed unit 2, and a fixing unit 4 that applies a fixing treatment to fix an unfixed toner image transferred on the paper P by the image forming unit 3 to the paper are provided in the device body 1*a*. A paper discharge unit 5 to which the paper P applied with the fixture treatment by the fixing unit 4 is discharged is further provided at an upper side of the device body 1*a*.

The paper feed unit 2 is equipped with a paper feed cassette 121, a pick-up roller 122, paper feed rollers 123, 124, 125, and a pair of resist rollers 126. The paper feed cassette 121 is provided detachably to the device body 1*a* and accommodates the paper P. The pick-up roller 122 is provided at a position of upper left of the paper feed cassette 121 as shown in FIG. 1 to pick up the paper P accommodated in the paper feed cassette 121 one by one. The paper feed rollers 123, 124, 125 send the paper P picked up by the pick-up roller 122 to a paper conveying path. The pair of resist rollers 126 direct the paper P sent to the paper conveying path by the paper feed rollers 123, 124, 125 to temporally wait and feed it to the image forming unit 3 at a predetermined timing.

The paper feed unit 2 is further equipped with a manual feed tray (not shown) attached at left side of the device body 1*a* shown in FIG. 1 and a pick-up roller 127. The pick-up roller 127 picks up the paper P disposed on the manual feed tray. The paper P picked up by the pick-up roller 127 is sent to a paper conveying path by the paper feed rollers 123, 125 and fed to the image forming unit 3 by the pair of resist rollers 126 at a predetermined timing.

The image forming unit 3 is equipped with an image forming part 7, an intermediate transfer belt 31 to which surface (contact side) a toner image based on image data telephotographed from computers etc. is primarily transferred by the image forming part 7, and a secondary transfer roller 32 that secondarily transfers the toner image on the intermediate transfer belt 31 to the paper P sent from the paper feed cassette 121.

The image forming part 7 is equipped with a black unit 7K, a yellow unit 7Y, a cyan unit 7C, and a magenta unit 7M from an upper stream side (right side in FIG. 1) to a downstream side in series along the moving direction of the intermediate transfer belt 31. In each of the units 7K, 7Y, 7C, and 7M, a drum-shaped latent image bearing member 37 as an image bearing member is disposed at each central position thereof rotatably along the arrow direction (clockwise direction). Furthermore, a charging unit 39, an exposure unit 38, a developing unit 71, a cleaning unit 8, a neutralization unit (not shown), etc. are disposed around each latent image bearing member 37 in series from an upper stream side of the rotating direction of the latent image bearing member 37.

The charging unit 39 uniformly charges the circumference of the latent image bearing member 37 which is being rotated in the arrow direction. The charging unit 39 is not particularly limited as long as it can uniformly charge the circumference of the latent image bearing member 37 and may be of non-contact or contact type. Specific examples of the charging unit include corona-charging devices, charging rollers, and charging brushes.

The surface potential (charged potential) of the latent image bearing member 37 is not particularly limited providing that it is within a range that does not inhibit the purpose of the present disclosure. Considering the balance between the developing property and the charging capacity of the latent image bearing member 37, the surface potential is preferably +200 V or higher and +500 V or lower, more preferably +200 V or higher and +300 V or lower. When the surface potential is excessively low, the development field becomes insufficient and thus it becomes difficult to assure the image density of resulting images. When the surface potential is excessively high, problems such as insufficient charging capacity of the latent image bearing member 37, insulation breakdown of the latent image bearing member 37, depending on a thickness of the photosensitive layer and an increase of the amount of generated ozone are likely to occur.

The latent image bearing member 37 may be exemplified by inorganic photoconductors such as of amorphous silicon and organic photoconductors where a mono-layer or laminated photoconductive layer containing organic components such as a charge generating agent, a charge transporting agent, and a binder resin is formed on a conductive substrate.

The exposure unit 38 is a so-called laser scanning unit where laser light is irradiated based on image data input from a personal computer (PC) as a higher-level device to the circumference of the latent image bearing member 37 uniformly charged by the charging unit 39, and an electrostatic latent image is formed on the latent image bearing member 37 based on the image data. The developing unit 71 supplies the toner of the present disclosure to the circumference of the latent image bearing member 37 where the electrostatic latent image has been formed, thereby forming a toner image based on image data. By use of the toner of the present disclosure, adhesion of the toner to development rollers (sleeves) equipped by the developing unit 71 can be suppressed and thus proper images can be formed. The configuration of the developing unit 71 is appropriately changed depending on type of developer and process method. The toner image formed on the circumference of the latent image bearing member 37 by the developing unit 71 is primarily transferred on the intermediate transfer belt 31.

After the primary transfer of the toner image to the intermediate transfer belt 31 is completed, the toner remaining on the circumference of the latent image bearing member 37 is cleaned by the cleaning unit 8. The cleaning unit 8 is equipped with the elastic blade 81 and removes the toner remaining on the circumference of the latent image bearing member 37 by the elastic blade 81. The elastic blade is formed from elastic materials such as urethane rubber and ethylene-propylene rubber. When the toner of the present disclosure is used, the toner is unlikely to pass through the cleaning unit 8, thus occurrence of image defects can be suppressed in resulting images.

The neutralization unit eliminates the charge at the circumference of the latent image bearing member 37 after the primary transfer. The circumference of the latent image bearing member 37, which has been subjected to the cleaning treatment by the cleaning unit 8 and the neutralization unit, proceeds to the charging unit 39 for fresh charging treatment and is subjected to the fresh charging treatment.

The intermediate transfer belt 31 is an endless belt-shaped rotator and is tensioned over a plurality of rollers such as a driving roller 33, a driven roller 34, a backup roller 35, and a primary transfer roller 36 such that its surface side (contact surface) contacts the circumferences of the latent image bearing members 37. Furthermore, the intermediate transfer belt 31 is configured such that it rotates endlessly by two or more rollers under the condition of being pressed toward the latent image bearing member 37 by the primary transfer rollers 36 disposed oppositely to the latent image bearing members 37. The driving roller 33 is rotatably driven by a driving source such as a stepping motor (not shown) and provides the intermediate transfer belt 31 with a driving force for endless rotation. The driven roller 34, the backup roller 35, and the primary transfer rollers 36 are disposed rotatably and driven to rotate by following the endless rotation of the intermediate transfer belt 31 by the driving roller 33. The rollers 34, 35, 36 are driven to rotate depending on the mover rotation of the driving roller 33 through the intermediate transfer belt 31 and also support the intermediate transfer belt 31.

The primary transfer roller 36 applies a primary transfer bias to the intermediate transfer belt 31. Thereby, the toner images formed on the latent image bearing members 37 are transferred in order (primary transfer) between each latent image bearing member 37 and each primary transfer roller 36 in the overlapping manner on the intermediate transfer belt 31 that is running around along the arrow direction (counterclockwise) by driving action of the driving roller 33.

The secondary transfer roller 32 applies a secondary transfer bias to the paper P. Thereby, the toner image primarily transferred on the intermediate transfer belt 31 is secondarily transferred on the paper P between the secondary transfer roller 32 and the backup roller 35; consequently, a color transfer image (unfixed toner image) is transferred on the paper P.

The fixing unit 4 applies a fixing treatment to the transfer image transferred on the paper P by the image forming unit 3 and is equipped with a heating roller 41 heated by an electric heater and a pressure roller 42 which is disposed oppositely to the heating roller 41 and of which the circumference is urged to contact the circumference of the heating roller 41.

Then, the transfer image, which has been transferred on the paper P by the secondary transfer roller 32 in the image forming unit 3, is fixed on the paper P by the fixture treatment of heating and pressing while the paper P is passing between the heating roller 41 and the pressure roller 42. Then, the fixture-treated paper P is discharged to the paper discharge unit 5. Furthermore, in the color printer 1 of this embodiment, two or more pairs of convey rollers 6 are placed at appropriate sites between the fixing unit 4 and the paper discharge unit 5.

The paper discharge unit 5 is formed by making a concave area at the top of the device body 1 of the color printer 1, and a discharged paper tray 51 to receive the discharged paper P is formed at the bottom of the concave area.

The color printer 1 forms an image on the paper P by actions for forming the image described above. As a result, by way of forming images using the toner of the present disclosure, image defects in resulting images due to the toner passing-through the cleaning units and image defects such as void in resulting images can be suppressed.

EXAMPLES

The present disclosure is explained more specifically with reference to examples below. In addition, the present disclosure is not limited to the examples.

A polyester resin used as a binder resin in Examples and Comparative Example was prepared in accordance with the process described in Preparation Example 1.

Preparation Example 1

1960 g of propylene oxide adduct of bisphenol A, 780 g of ethylene oxide adduct of bisphenol A, 257 g of dodecenyl succinic anhydride, 770 g of terephthalic acid, and 4 g of dibutyltin oxide were introduced into a reaction container. Next, the temperature in the reaction container was raised to 235° C. while stirring under a nitrogen atmosphere. Then, after allowing to react at the same temperature for 8 hours, pressure inside the reaction container was reduced to 8.3 kPa and reaction was allowed to proceed for 1 hour, thereby obtaining a reaction mixture. Thereafter, the reaction mixture was cooled to 180° C., and trimellitic anhydride was added to the reaction container so that the reaction mixture had a desired acid number. Then, the temperature of the reaction mixture was raised to 210° C. at a rate of 10° C./hr and reaction was allowed to proceed at the same temperature. After completing the reaction, the content in the reaction container was taken out and cooled, thereby obtaining a polyester resin.

Example 1

100 parts by mass of the polyester resin resulting from Preparation Example 1, 5 parts by mass of Carnauba wax (Carnauba wax No. 1 by S. Kato. & Co.), 2 parts by mass of a charge control agent (P-51, by Orient Chemical Industries Co.), and 5 parts by mass of carbon black (MA100, by Mitsubishi Chemical Co.) were mixed using a mixer, then the mixture was melted and kneaded using a twin screw extruder to obtain a kneaded material. The kneaded material was coarsely pulverized using a pulverizing device (Rotoplex, by Toakikai Co.) to obtain a coarsely pulverized material with a volume average particle diameter (D50) of about 20 μm, and the coarsely pulverized material was finely pulverized by dividing 5 times in series using a mechanical pulverizing device (Turbo mill, by Turbo Industries, Co.) to obtain a finely pulverized material. Then, the finely pulverized material was classified using a classifier (Elbow Jet, by Nittetsu Mining Co.) to obtain toner particles with a volume average particle diameter (D50) of 6.8 μm. The resulting toner particles were heat-treated at 200° C. using a heat-treatment device (SUFFUSION, by Nippon Pneumatic Mfg. Co.).

To the resulting toner particles, 1.8% by mass of hydrophobic silica (REA 200, by Japan Aerosil Co.) and 1.0% by mass of titanium oxide (EC-200, by Titan Kogyo, Ltd.) based on the mass of the toner particles were added, then which was stirred and mixed for 5 minutes using a HENSCHEL MIXER at a rotational circumferential velocity of 30 m/sec to obtain a toner with a volume average particle diameter of 6.81 μm. The volume average particle diameter of the toner was measured in accordance with the process below.

Furthermore, the resulting toner was measured for an average circularity of toner particles having a primary particle diameter of 3 μm or more and 10 μm or less and a numerical proportion of toner particles having a concave portion of which outer diameter is 200 nm or more in accordance with the processes below. These measurement results are shown in Table 1.

Method of Measuring Volume Average Particle Diameter

A volume average particle diameter was measured using a Coulter Counter Multisizer 3 (by Beckman Coulter Inc.). Isoton II (by Beckman Coulter Inc.) was used as an electrolyte and an aperture of 100 μm was used as the aperture thereof. 10 mg of the toner was added to a solution of the electrolyte (Isoton II) to which a small amount of a surfactant had been added, and the toner was dispersed into the electrolyte using an ultrasonic dispersing device. An electrolyte where the toner had been dispersed was used as a measurement sample, and a particle size distribution of the toner was measured using the Coulter Counter Multisizer 3 to determine a volume average particle diameter of the toner.

Method of Measuring Average Circularity

An average circularity of the toner was measured using a Flow Particle Image Analyzer (FPIA-3000, by Sysmex Co.). Under an environment of 23° C. and 60% RH, toner particles having an equivalent circle diameter of 0.60 μm or more and 400 μm or less were measured for a circumferential length ($L_0$) of a circle having a projected area the same as that of the particle image and a peripheral length (L) of a particle-projected image, and the circularity was determined using the formula below. The sum of circularities of toner particles having an equivalent circle diameter of 3 μm or more and 10 μm or less was divided by a total particle number of toner particles used to measure having an equivalent circle diameter of 3 μm or more and 10 μm less, and the resulting value was defined as the average circularity.

(Equation to Calculate Circularity)

$$\text{Circularity}=L_0/L$$

Method of Measuring Numerical Proportion of Toner Particles Having Concave Portion with Outer Diameter of 200 nm or More 100 toner particles contained in an image taken at a magnification of 3000 using a scanning electron microscope were checked for existence or nonexistence of a concave portion with an outer diameter of 200 nm or more, and the number of toner particles having one or more concave portions with an outer diameter of 200 nm or more was counted. Base on the counted number of toner particles having a concave portion with an outer diameter of 200 nm or more, a numerical proportion of toner particles having a concave portion with an outer diameter of 200 nm or more versus 100 toner particles was calculated.

In addition, toner particles having a concave portion were measured for an outer diameter of the concave portion. The outer diameter of the concave portion was measured after the resulting image was image-treated and binarized by an automatic binarizing treatment (mode: P-tile) using an image analysis software (WINROOF, ver.5.5.0, by Mitani Co.). By way of the binarizing treatment, the toner in the image was distinguished between concave portions and other portions. With respect to the concave portions of the image after the binarizing treatment, a longest distance between two points selected arbitrarily on a circumference of a concave portion was determined as an outer diameter of the concave portion.

Preparation of Two-Component Developer

A carrier (ferrite carrier, by Powdertech Co.) and the toner of 10% by mass based on mass of the ferrite carrier were mixed using a ball mill for 30 minutes to prepare a two-component developer. Using the resulting two-component developer, image density, transfer property, and cleaning property of the toner of Example 1 were evaluated in accordance with the processes below. The evaluation results of the toner of Example 1 are shown in Table 2.

Evaluation of Image Density

Under an environment of normal temperature and normal humidity (20° C., 65% RH), the two-component developer prepared as described above was filled into a developing unit for black color of a printer (FS-05016, by Kyocera Mita Co.) and the toner prepared as described above was filled into a toner container for black color thereof. Then, an initial image was obtained by printing an image evaluation pattern using the printer. Thereafter, 20000-sheet continuous printing was carried out at a coverage rate of 2% under an environment of normal temperature and normal humidity (20° C., 65% RH), then the image evaluation pattern was printed. Image densities of solid images included in the image evaluation pattern printed in the initial image and after 20000-sheet continuous printing were measured using a reflection density meter (RD914, by GretagMacbeth Co.). The image density was evaluated by the criteria below with respect to an amount of image density which had lowered after 20000-sheet printing from the image density of the initial image.

Good: the lowered amount was 0.15 or less; and

Bad: the lowered amount was above 0.15.

Evaluation of Transfer Property (Void Evaluation)

Evaluation was performed using the printer (FS-05016, by Kyocera Mita Co.). The two-component developer was filled into a development device and a thin-line image was formed as an initial image. Existence or nonexistence of a void on the thin-line image was observed using a loupe and transfer property was evaluated in accordance with the criteria below. Evaluation allowable in practice is 5 and 4.

5: non-occurrence of void;

4: very little occurrence of void;

3: occurrence of a small amount of void;

2: local occurrence of much void; and

1: extensive and noticeable occurrence of void.

Evaluation of Cleaning Property

Evaluation was performed using the printer (FS-05016, by Kyocera Mita Co.). The printer was equipped with a cleaning unit having an elastic blade. An image of white paper was formed immediately after forming a solid image, then a condition of passing-through of the toner was visually observed and evaluated. Evaluation allowable in practice is 3.

3: no black streak due to passing-through of toner was observed in the image of white paper;

2: black streak due to passing-through of toner was slightly observed in the image of white paper; and 1: a considerable amount of black streak due to passing-through of toner was observed in the image of white paper.

Examples 2 to 6 and Comparative Examples 1 to 7

Toners of Examples 2 to 6 and Comparative Examples 1 to 7 were obtained similarly to Example 1 except that the fine pulverizing was performed by dividing it a plurality of times in series shown in Table 1 and heat-treatment was performed at the temperature shown in Table 1. Here, toners of Comparative Examples 6 and 7 were not heat-treated.

Similarly to Example 1, the toners of Examples 2 to 6 and Comparative Examples 1 to 7 were measured for an average circularity, a volume average particle diameter (D50), and a numerical proportion of toner particles having a concave portion with an outer diameter of 200 nm or more. The measurement results are shown in Table 1.

Similarly to Example 1, the toners of Examples 2 to 6 and Comparative Examples 1 to 7 were also measured for image density, transfer property, and cleaning property. The measurement results of the toners of Examples 2 to 6 and Comparative Examples 1 to 7 are shown in Table 2.

TABLE 1

| | Number of pulverizing steps (Times) | Temperature at heat treatment (° C.) | Average circularity | Volume average particle diameter (μm) | Numerical proportion (%) of particles having one or more concave portions with an outer diameter of 200 nm or more |
|---|---|---|---|---|---|
| Example 1 | 5 | 200 | 0.970 | 6.81 | 6 |
| Example 2 | 5 | 180 | 0.968 | 6.85 | 8 |
| Example 3 | 5 | 180 | 0.969 | 6.62 | 5 |
| Example 4 | 5 | 180 | 0.967 | 7.08 | 6 |
| Example 5 | 3 | 180 | 0.961 | 6.71 | 7 |
| Example 6 | 5 | 220 | 0.977 | 6.79 | 2 |
| Comparative Example 1 | 5 | 250 | 0.983 | 6.78 | 0 |
| Comparative Example 2 | 5 | 300 | 0.989 | 6.79 | 0 |
| Comparative Example 3 | 5 | 300 | 0.982 | 7.11 | 0 |
| Comparative Example 4 | 5 | 150 | 0.969 | 6.82 | 15 |
| Comparative Example 5 | 5 | 120 | 0.965 | 6.84 | 25 |
| Comparative Example 6 | 2 | — | 0.950 | 6.85 | 47 |
| Comparative Example 7 | 1 | — | 0.945 | 6.86 | 53 |

TABLE 2

| | Image density | | | | |
|---|---|---|---|---|---|
| | Initial | 20000-sheet printing | Evaluation | Transfer ability | Cleaning ability |
| Example 1 | 1.38 | 1.25 | Good | 4 | 3 |
| Example 2 | 1.41 | 1.28 | Good | 4 | 3 |
| Example 3 | 1.42 | 1.31 | Good | 4 | 3 |
| Example 4 | 1.41 | 1.32 | Good | 4 | 3 |
| Example 5 | 1.39 | 1.24 | Good | 4 | 3 |
| Example 6 | 1.42 | 1.40 | Good | 5 | 3 |
| Comparative Example 1 | 1.48 | 1.42 | Good | 5 | 1 |
| Comparative Example 2 | 1.49 | 1.44 | Good | 5 | 1 |
| Comparative Example 3 | 1.45 | 1.40 | Good | 5 | 1 |
| Comparative Example 4 | 1.39 | 1.16 | Bad | 4 | 3 |
| Comparative Example 5 | 1.38 | 1.12 | Bad | 4 | 3 |
| Comparative Example 6 | 1.35 | 1.07 | Bad | 3 | 3 |
| Comparative Example 7 | 1.35 | 1.03 | Bad | 3 | 3 |

It is understood from Examples 1 to 6 that when an average circularity of toner particles is 0.960 or more and 0.980 or less with respect to toner particles having a primary particle diameter of 3 μm or more and 10 μm or less, and a numerical proportion of toner particles, having a concave portion of which outer diameter is 200 nm or more, is 10% by number or less in the toner, in which 100 by number of the toner particles are observed using a scanning electron microscope and the outer diameter is measured from an image of the scanning electron microscope; image density of resulting image is unlikely to become lower than a desired value when printing at a lower coverage rate for a long period and image defects or voids in resulting images due to transfer residual toner passing-through cleaning units are unlikely to occur in resulting images even.

In the toners of Comparative Examples 1 to 3, every average circularity of toner particles having a primary particle diameter of 3 μm or more and 10 μm or less was above 0.980 since heat treatment was performed at 250° C. or 300° C. For this reason, when the toners of Comparative Examples 1 to 3 were used, passing-through of transfer residual toner was likely to occur at cleaning units and cleaning property was poor.

Since the toners of Comparative Examples 4 and 5 were heat-treated at a lower temperature of 150° C. or 120° C., the numerical proportion of toner particles, having a concave portion of which outer diameter is 200 nm or more, was 10% by number or more in every toner. For this reason, when the toners of Comparative Examples 4 and 5 were used, the external additive was likely to be embedded in concave portions of toner particles and thus toner particles became resistant to being uniformly charged when printing at a lower coverage rate for a long period. Therefore, when the toners of Comparative Examples 4 and 5 were used, image density after 20000-sheet printing was considerably lower than a desired value.

Since the toners of Comparative Examples 6 and 7 were not heat-treated, the numerical proportion of toner particles, having a concave portion of which outer diameter is 200 nm or more, was 10% by number or more. For this reason, when the toners of Comparative Examples 6 and 7 were used, the external additive was likely to be embedded in concave portions of toner particles and thus toner particles became resistant to being uniformly charged when printing at a lower coverage rate for a long period. Therefore, when the toners of Comparative Examples 6 and 7 were used, image density after 20000-sheet printing was considerably lower than a desired value. Additionally, since the toners of Comparative Examples 6 and 7 were not heat-treated, the average circularity was lower. For this reason, the toners of Comparative Examples 6 and 7 were likely to adhere to the surface of the latent image bearing member and voids were likely to occur in resulting images.

The invention claimed is:

1. A toner for electrostatic latent image development, comprising a colorant, a charge control agent, and a release agent in a binder resin and not comprising a magnetic powder, the toner being produced using a pulverizing process, wherein the charge control agent is a quaternary ammonium salt, the release agent is a carnauba wax, the binder resin is a polyester resin obtained by a method comprising:

obtaining a reaction mixture by reacting (A) propylene oxide adduct of bisphenol A, (B) ethylene oxide adduct of bisphenol A, (C) dodecenyl succinic anhydride, and (D) terephthalic acid in the presence of (E) dibutyltin oxide at a mass ratio (A)/(B)/(C)/(D)/(E) of 1960/780/257/770/4 at 235° C. for 8 hours, further reacting the reaction mixture under a reduced pressure of 8.3 kPa at 235° C. for 1 hour, adjusting the acid number of the reaction mixture after reacting at the reduced pressure by adding trimellitic anhydride thereto at 180° C., raising the temperature of the reaction mixture after adding the trimellitic anhydride at a rate of 10° C./hr. up to 210° C., and still further reacting the reaction mixture to complete the reaction, and cooling the reaction mixture after the reaction is complete to obtain the polyester resin, an average circularity of toner particles is 0.960 or more and 0.980 or less with respect to toner particles having a primary particle diameter of 3 μm or more and 10 μm or less, and a numerical proportion of toner particles, having a concave portion of which outer diameter is 200 nm or more, is 10% by number or less, in which 100 by number of the toner particles are observed using a scanning electron microscope and the outer diameter is measured from an image of the scanning electron microscope.

2. The toner for electrostatic latent image development according to claim 1, wherein the numerical proportion of toner particles, having a concave portion of which outer diameter is 200 nm or more, is 5% by number or less.

3. The method of producing a toner for electrostatic latent image development according to claim 1, comprising the following steps (i) to (v):

(i) mixing the binder resin, the colorant, the charge control agent, and the release agent, followed by melting and kneading them, (ii) roughly pulverizing the melt-kneaded material resulting from the step (i) to obtain a coarsely pulverized material, (iii) finely pulverizing the coarsely pulverized material by dividing a fine pulverization of the coarsely pulverized material into a plurality of times in series to obtain finely pulverized material, (iv) classifying after the pulverization to obtain a classified material, and (v) heat-treating the classified material to obtain a toner with a predetermined volume average particle diameter.

4. The method of producing a toner for electrostatic latent image development according to claim 3, wherein the step (iv) is a step of heat-treating the pulverized material at 180° C. or higher and 220° C. or lower.

5. The toner of claim 1, wherein the colorant is carbon black.

* * * * *